US010827284B2

(12) United States Patent
Gajstut

(10) Patent No.: US 10,827,284 B2
(45) **Date of Patent: *Nov. 3, 2020**

(54) AUDIO AMPLIFICATION ELECTRONIC DEVICE WITH INDEPENDENT PITCH AND BASS RESPONSE ADJUSTMENT

(71) Applicant: Enrique Gajstut, Sunny Isles Beach, FL (US)

(72) Inventor: Enrique Gajstut, Sunny Isles Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/400,067

(22) Filed: May 1, 2019

(65) Prior Publication Data

US 2019/0289406 A1 Sep. 19, 2019

Related U.S. Application Data

(63) Continuation of application No. 15/483,996, filed on Apr. 10, 2017, now Pat. No. 10,284,966.

(60) Provisional application No. 62/320,672, filed on Apr. 11, 2016.

(51) Int. Cl.
*H04R 25/00* (2006.01)

(52) U.S. Cl.
CPC ..... *H04R 25/353* (2013.01); *H04R 25/305* (2013.01); *H04R 25/505* (2013.01); *H04R 2225/021* (2013.01); *H04R 2225/43* (2013.01); *H04R 2225/61* (2013.01); *H04R 2430/01* (2013.01); *H04R 2460/03* (2013.01)

(58) Field of Classification Search
CPC .. H04R 25/353; H04R 25/505; H04R 25/305; H04R 2225/021; H04R 2225/43; H04R 2225/61; H04R 2460/03
See application file for complete search history.

(56) References Cited

U.S. PATENT DOCUMENTS

| | | | | |
|---|---|---|---|---|
| 6,021,207 A * | 2/2000 | Puthuff | H04R 1/1016 381/315 |
| 9,204,231 B1 * | 12/2015 | Menzl | H04R 25/70 |
| 2014/0029776 A1 * | 1/2014 | Dundas | H04R 25/75 381/314 |

* cited by examiner

*Primary Examiner* — Brian Ensey
(74) *Attorney, Agent, or Firm* — Franco S. DeLiguori; DP IP Group

(57) ABSTRACT

Techniques used to selectively amplify audio signals are described herein in connection with audio amplification electronic devices, such as hearing aids, including over-the-ear hearing aids. A device and its operation are described to facilitate setting low and high tone/volume controls separately, using at least two selection mechanisms. In one aspect, a first selection mechanism includes a pitch frequency control rocker switch and the second selection mechanism includes a bass frequency control rocker switch disposed separately. In one aspect, the bass frequency control rocker switch causes a processor to bias the frequency response of the sound amplifier for frequencies below 1 kHz. In another aspect, the pitch frequency control rocker switch causes a processor to bias the frequency response of the hearing for frequencies above 1 kHz. In another aspect, the selection mechanism involves the separate attenuation of treble and bass adjustments in response to a user selection of a rocker switch setting for each adjustment.

2 Claims, 8 Drawing Sheets

300

| NO | | PART(S) | SIZE | POSITION | QTY |
|---|---|---|---|---|---|
| 1 | | chip Resistor | SMD RES 2.2KΩ 0402 ±5% | R1、R9 | 2 |
| 2 | | chip Resistor | SMD RES 330Ω 0402 ±5% | R2 | 1 |
| 3 | | chip Resistor | SMD RES 1KΩ 0402 ±5% | R3 | 1 |
| 4 | | chip Resistor | SMD RES 2.7kΩ 0402 ±5% | R4、R5 | 2 |
| 5 | | chip Resistor | SMD RES 10Ω 0402 ±5% | R6 | 1 |
| 6 | | chip Resistor | SMD RES 47kΩ 0402 ±5% | R7 | 1 |
| 7 | | chip Resistor | SMD RES 18kΩ 0402 ±5% | R14 | 1 |
| 8 | | chip Resistor | SMD RES 150kΩ 0402 ±5% | R8 | 1 |
| 9 | | chip Resistor | SMD RES 82kΩ 0402 ±5% | R10、R11 | 2 |
| 10 | | chip Resistor | SMD RES 100Ω 0402 ±5% | R12、R13、R15 | 3 |
| 11 | | chip Capacitor | SMD 0603 CAP 16V Y5V | C1、C4、C6、C15、C16 | 5 |
| 12 | | chip Capacitor | SMD 0402 CAP 16V Y5V | C3、C5、C2、C10、C17 | 5 |
| 13 | | chip Capacitor | SMD 0402 CAP 16V Y5V | C7、C11 | 2 |
| 14 | | chip Capacitor | SMD 0402 CAP 16V Y5V | C8、C13 | 2 |
| 15 | | chip Capacitor | SMD 0402 CAP 16V Y5V | C9、C14 | 2 |
| 16 | | chip Capacitor | SMD 0402 CAP | C12 | 1 |
| 17 | | chip Capacitor | SMD 0603 CAP 50V Y5V | C18 | 1 |
| 18 | | The Patch Field Effect Tub | Super Tiny sealed by SOT | Q1 | 1 |
| 19 | | IC | MSOP-10L IC-ROHS super Tiny | IC3 | 1 |
| 20 | | IC | ROHS | IC1 | 1 |
| 21 | | IC | MSOP-10L 贴片IC-ROHS Super Tiny | IC4 | 1 |
| 22 | | IC | 1.5V | IC2 | 1 |
| 23 | | CHIP SWITCH | TR-102 | SW1 | 1 |
| 24 | | LED | SMD Red-Green Light | LED | 1 |
| 25 | | USB JACK | DC charging USB 5Pin | USB | 1 |
| 26 | | PCB | Double-sided epoxy resin plate,0.6mm, | | 1 |
| 27 | | LIGHT TOUCH KEY | TSI-661B | S1、S2、S3、S4 | 4 |
| 28 | | lithium battery | with protection board | | 1 |
| 29 | | Micphone | ø4015 solder 2CMm lines ; with cover | MIC1 | 1 |
| 30 | | earphone (speaker) | ø10; | | 1 |
| 31 | | earphone wire | Length=125 2 sides Decrustation each for 10mm, 2 sides wicking each for 3mm | | 1 |
| 32 | | plstic front shell | yellow color ,ABS | | 1 |
| 33 | | plastic back shell | yellow color ,ABS | | 1 |
| 34 | | Plastic Button (VOL+&VOL- | (VOL+&VOL-) | | 1 |
| 35 | | Plastic Touch (VOL+&VOL-) | plastic touch yellow ,ABS | | 1 |
| 36 | | Plastic Switch | yellow color ,ABS | | 1 |
| 37 | | Earphone Hang Hitch | White,ABS; diameter ø1.2mm | | 1 |
| 38 | assemble | Speaker Plastic front shel | Yellow color ,ABS | | 1 |
| 39 | | Speaker Plastic back shel | Yellow color ,ABS | | 1 |
| 40 | | EVA pad | Single with glue ; 6*2.5*4 Black | Stick behind speaker | 1 |
| 41 | | EVA pad | Single with Glue; 外径ø10mm; thickness ; 1.0mm | Stick front speaker | 1 |
| 42 | | Screw | TP1.0×5B | back shell | 3 |
| 43 | | Transparent Plastic tube | 25*ø3*ø2mm, | earphone wire | 1 |

FIG.5

| | | |
|---|---|---|
| 1 | Max. saturation sound pressure level(OSPL90) | ≤129+3dB |
| 2 | Full on Acoustic Gain | 38±5 dB |
| 3 | Total Harmonic Distortion(THD) | ≤10% |
| 4 | Equivalent Input Noise | ≤32dB |
| 5 | Frequency Response | 450～3000Hz |
| 6 | Current Drain | ≤1.5mA |

FIG. 6

AUDIO AMPLIFICATION ELECTRONIC DEVICE WITH INDEPENDENT PITCH AND BASS RESPONSE ADJUSTMENT

CROSS-REFERENCE TO RELATED APPLICATIONS

This application is a continuation of U.S. application Ser. No. 15/483,996, filed Apr. 10, 2017, which claims the benefit U.S. Provisional Application No. 62/320,672, filed Apr. 11, 2016, the contents of which are incorporated herein by reference in their entirety.

TECHNICAL FIELD

The present disclosure relates to audio amplification electronic devices, and more specifically to sound amplifiers, such as hearing aid devices.

BACKGROUND

Hearing loss is a common condition within the human population and the manifestation of hearing loss can have a significant impact to the quality of human life. There are many factors that can induce hearing loss which may include disease, genetic disposition, injury, and normal aging. However, different human individuals often exhibit varying levels and manifestations of hearing loss that may change over time. Furthermore, the audio environment that the individual is placed in may have a significant impact to the ability to hear desired sounds. For example, an individual that is in a small room setting while attempting to listen to another individual speak within a relatively quiet amount of ambient background noise may have difficulty depending on the speech characteristics of the person trying to speak, while the same individual who is trying to listen is placed in a crowded room or environment, such as a restaurant, may hear a high amount of sound energy, but the ambient background noise is relatively high resulting in a poor ability for the hearing individual to hear and understand individuals who may be speaking to the hearing individual.

The hearing loss may manifest as an attenuation of hearing sensitivity across the full hearing audio spectrum range, the spectrum range comprising approximately 100 Hz to approximately 8000 Hz. Furthermore, an individual's hearing loss may manifest as an ability to hear higher frequencies (above 1000 Hz), but not lower frequencies (below 1000 Hz). The converse may also be true, wherein the hearing loss manifests as an ability to hear lower frequencies (below 1000 Hz), but not hear well above 1000 Hz.

Therefore, it is desirable for a manufacturer of hearing aids and like devices to be able to accommodate many individuals with varying degrees and type of hearing loss that can be adjusted for the individual in a compact device that can be worn on the body and is relatively low cost.

SUMMARY

The present disclosure is directed to an improved audio amplification electronic device. The device is configured to facilitate setting low and high tone/volume controls separately, using at least two selection mechanisms. In one aspect, a first selection mechanism includes a pitch frequency control rocker switch and the second selection mechanism includes a bass frequency control rocker switch disposed separately. In one aspect, the bass frequency control rocker switch causes a processor to bias the frequency response of the sound amplifier for frequencies below 1 kHz. In another aspect, the pitch frequency control rocker switch causes a processor to bias the frequency response of the hearing for frequencies above 1 kHz.

In another aspect, the selection mechanism involves the separate attenuation of treble and bass adjustments in response to a user selection of a rocker switch setting for each adjustment.

BRIEF DESCRIPTION OF THE DRAWINGS

FIG. 5 is a table showing the component count and specification for the circuit diagram 300 and the assembly of the hearing aid 100 in the current exemplary embodiment.

FIG. 6 is a table showing the technical specification details for the hearing aid 100 in the current exemplary embodiment

DETAILED DESCRIPTION

The techniques described herein may be used in any device that is used to selectively amplify audio signals. Desired frequency responses may be realized through digital filters such as finite impulse response (FIR) or infinite impulse response (IIR) filters. Furthermore, desired frequency responses may also be realized through use of analog filters, or the combination digital and analog filters, as is known in the art.

Figure 1:
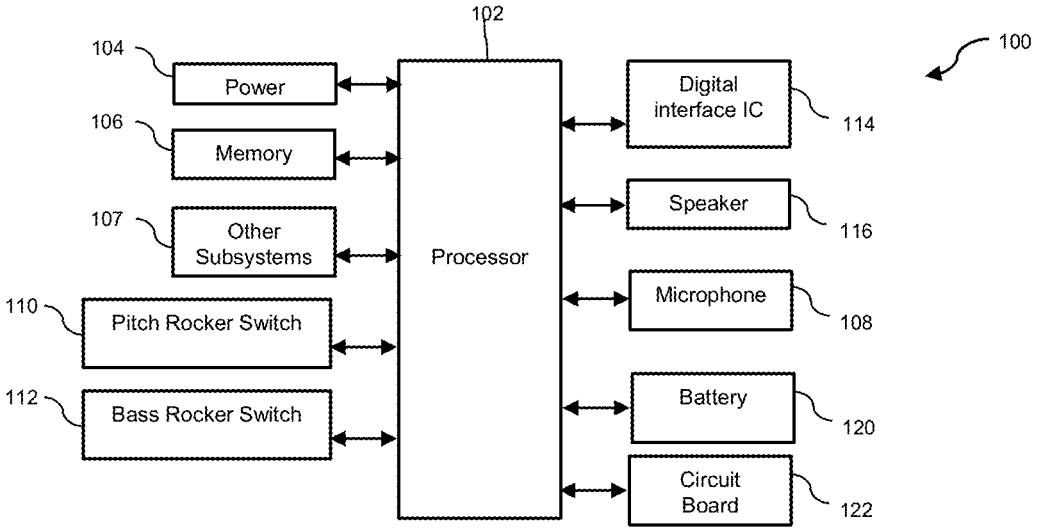
FIG. 1 shows a block diagram in accordance with an exemplary embodiment of an electronic device as a sound amplifier according to the present invention in the form of a hearing aid device generally designated at 100.

FIG. 1 shows a block diagram in accordance with the exemplary embodiment of an electronic device as a sound amplifier 100 according to the present invention. In the exemplary embodiment, the sound amplifier 100 is a hearing aid comprising multiple components, such as a processor 102 that controls the overall operation of hearing aid 100. Processor 102 is coupled to memory 106, which may be random access memory (RAM) used during operation (e.g. for manipulating output signals, processing input signals, etc.), and/or Read Only Memory (ROM) or flash memory, where software resides to instruct processor 100 to control the overall operation of hearing aid 100.

Processor 102 may also have a power control module 104 coupled to manage battery life and minimize power usage of the device. Digital interface IC 114 is coupled to processor 102 and may comprise analog audio conditioning circuitry such as Analogue to Digital (A/D) and Digital to Analogue (D/A) converters, audio power amplifiers, and may have the ability to perform digital or analog filtering of desired responses. Furthermore, digital interface IC 114 may also condition analog signals received from microphone 108. The main inventive step of hearing aid 100 is the ability for a user to independently control the frequency response of amplified ambient audio signals, depending on the user preference, alleviating the need to have a medical doctor or practitioner to perform the necessary tuning of the hearing aid device every time retuning is required. It is desirable to enable the ability to independently control pitch (frequencies above 1000 Hz) and bass (frequencies below 1000 Hz) but in a compact form factor that is easy to use. If too many external controls exist for hearing aid 100, then the device must have a larger physical footprint, which is not desirable. Therefore, hearing aid 100 further comprises pitch rocker switch 110 and bass rocker switch 112 which are coupled to processor 102 and are large enough for an average user to actuate, but small enough to not impact the overall physical footprint of hearing aid 100. Hearing aid 100 further comprises speaker 116, microphone 108, battery 120, and circuit board 122 coupled to processor 102. Speaker 116 outputs an amplified audio signal that is heard by the user of hearing aid 100. Circuit board 122 is a compact electronic multi-layer printed circuit board as known in the art, and all electrical components of hearing aid 100 are coupled to it, using techniques known in the art. Hearing aid 100 may further comprise other subsystems 107 coupled to processor 102. Examples of other subsystems 107 may include a USB charging port, one or more light indicators (not shown), and the like.

Figure 2:
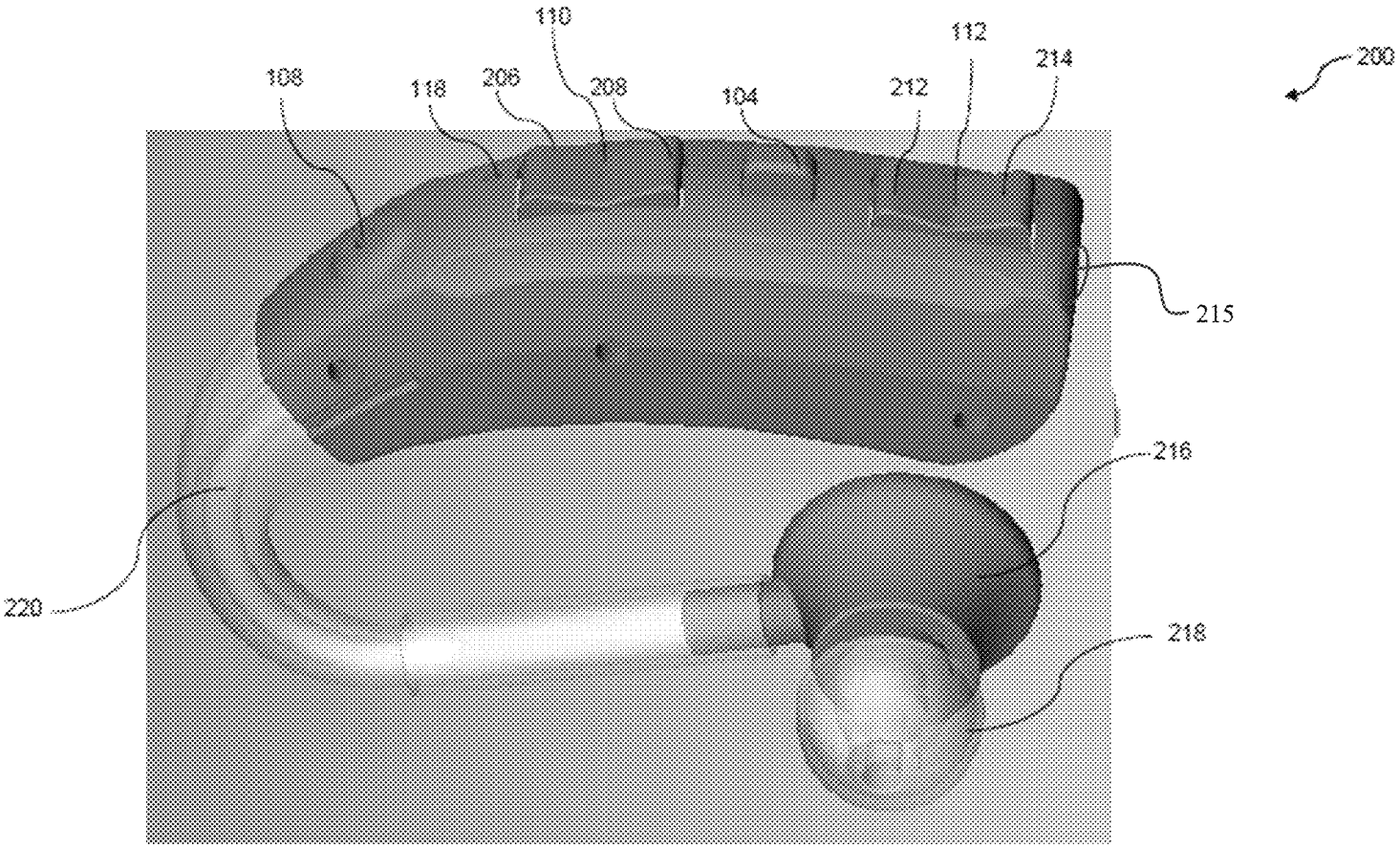
FIG. 2 shows a mechanical representation, generally designated at 200, in accordance with the exemplary embodiment.

FIG. 2 shows a mechanical representation 200 of hearing aid 100 in accordance with the exemplary embodiment. The exterior of hearing aid 100 comprises charging light indicator 118, microphone 108, pitch rocker switch 110, power switch 104 and bass rocker switch 112. Rocker switch 110 comprises a three position switch which functions to increase bass frequency response when pressed into position 206, decrease bass frequency response when pressed into position 208, and not adjusting the frequency response from the current setting which is the middle position that is the default when rocker switch 110 is not being actuated by a user. In a similar manner, rocker switch 112 comprises a three position switch which functions to increase pitch frequency response when pressed into position 212, decrease pitch frequency response when pressed into position 214, and not adjusting the frequency response from the current setting which is the middle position that is the default when rocker switch 112 is not being actuated by a user. Rocker switches 110 and 112 are known in the art, and the configuration of which position of either rocker switches 110 and 112 corresponds to increasing or decreasing a frequency response may be reversed, as a skilled artisan would understand. Mechanically, hearing aid 100 further comprises a charging port 215 (mini USB, or micro USB, or other compact port specification), a mechanical audio coupler 220, 216, and earpiece 218 which channel audio output by speaker 116 into a user's ear. The mechanical audio coupler 220 is formed into an ear hook component for securing the hearing aid device onto its user's ear, which in turn is mechanically coupled via a tube to an ear mold 216 upon which the earpiece 218 is attached. The ear mold 216 helps the earpiece 218 be accurately positioned at the outer opening of the ear canal. Speaker 116 is located at the end of the mechanical audio coupler near or on the printed circuit board in the main body of the hearing aid 100 and away from the ear mold 216. Hearing aid 100 is classified as an "over the ear" device, a designation known well in the art.

In a variation of the present exemplary embodiment of the invention shown in FIG. 2, speaker 116 may be located in the ear mold 216 and close to the ear canal outer opening. The cables connecting speaker 116 with the other electronic components of the hearing aid 100 run inside the ear hook 220 and the attached tube.

Figure 3:
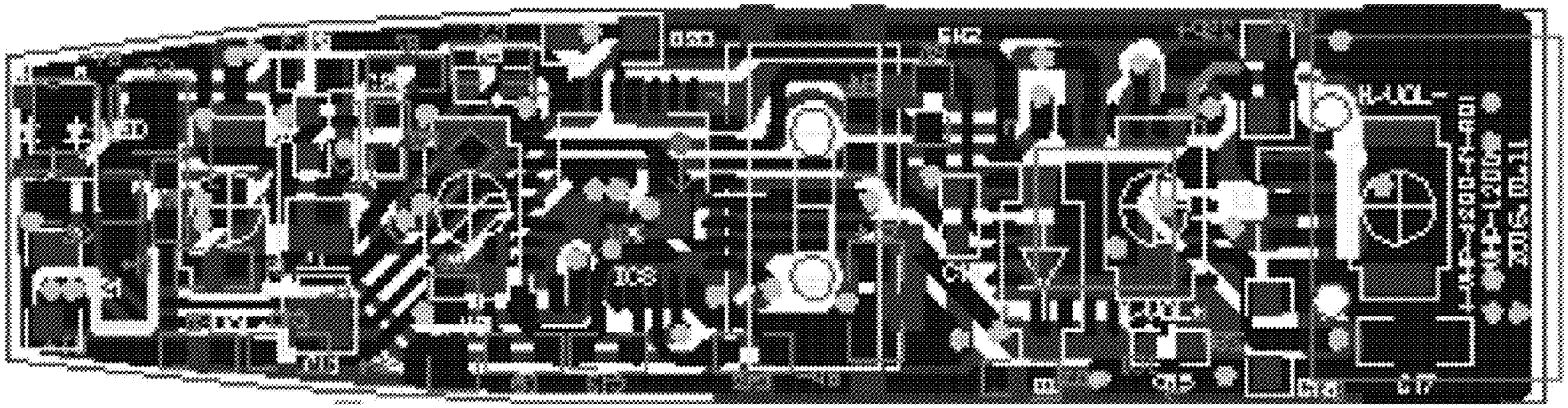
FIG. 3 shows an example printed circuit board layout of a circuit board 122 in accordance with the exemplary embodiment.

FIG. 3 shows an example printed circuit board layout of circuit board 122 in accordance with the exemplary embodiment. Circuit board 122 demonstrates that all components comprising hearing aid 100 can be compactly put together into a functioning unit. In the alternative exemplary embodiment, previously discussed, speaker 116 is not located inside the printed circuit 122 but external to it, electrically coupled to the printed circuit by means of wires running inside the tube and ear hook 220.

Figure 4:
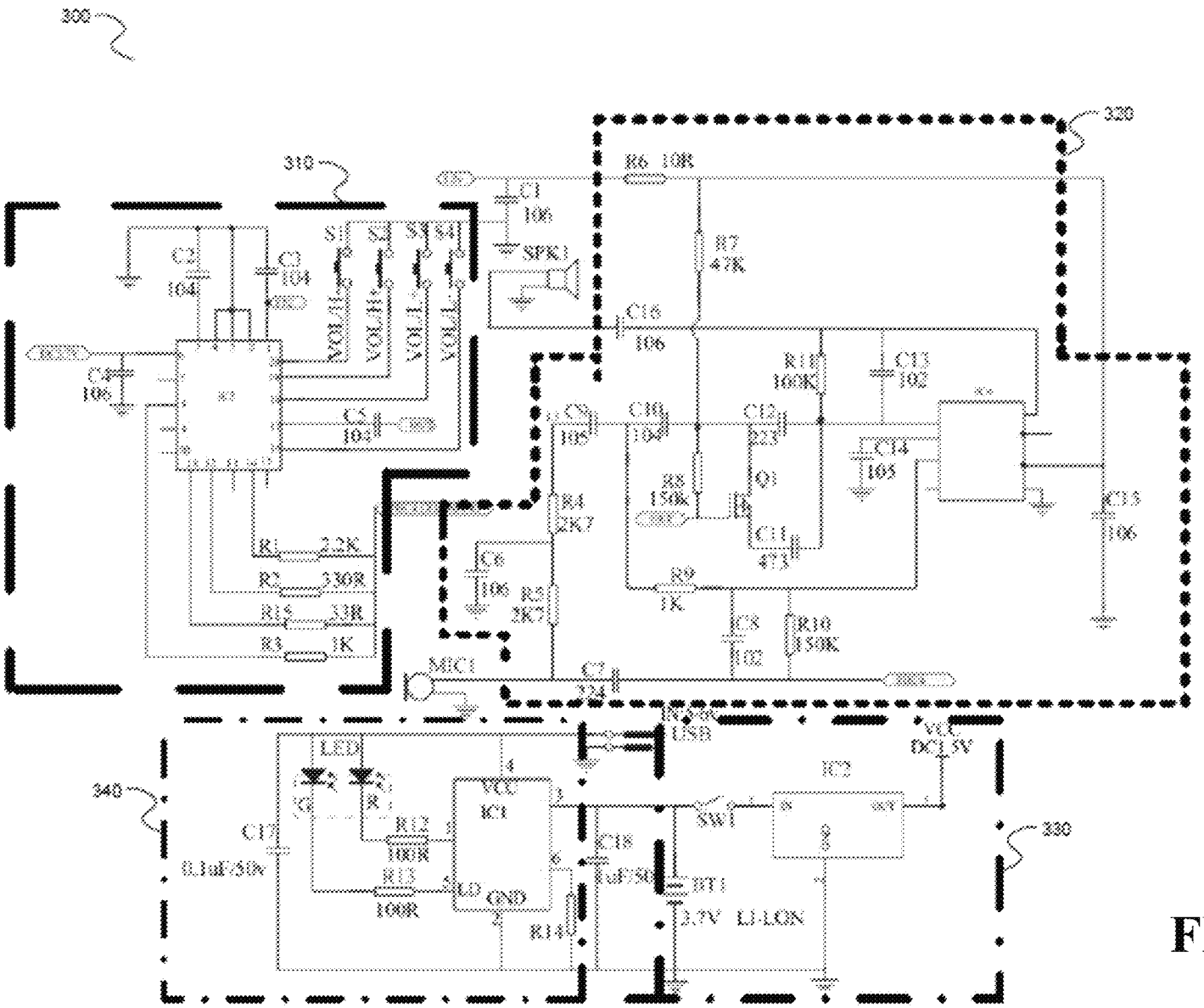
FIG. 4 shows the circuit diagram 300 for the hearing aid device designated at 100.

FIG. 4 shows a circuit diagram 300 for the hearing aid device designated at 100. Circuit diagram 300 comprises a number of ICs (IC1-IC4) and other electronic components, including resistors (R1-R14), capacitors (C1-C18), speaker (SPK1), microphone (MIC1), switches (SW1, S1-S4), battery (BT1), LEDs (G, R), transistor (Q1) and USB connector (USB).

Circuit diagram 300 is characterized by four main sub-circuits 310, 320, 330 and 340.

Controller sub-circuit 310 includes IC3—which is a microprocessor or similar component—is responsible for capturing user adjustments to pitch and bass frequency amplification bias via signals from switches S1-S4. Controller sub-circuit 310 also commands the sound signal amplification sub-circuit 320 to selectively amplify the sound input signal frequencies received from microphone MIC1. These components are connected via capacitors C1-C5 and resistors R1-R3 and R15.

Sound signal amplification sub-circuit 320 comprises IC4, resistors R6-10, capacitors C6-C16 and transistor Q1. Sub-circuit 320 performs the selective sound signal amplification according to the signals received from IC3.

Battery sub-circuit 330 comprises Li-Ion battery BT1 of 3.7 volts, voltage regulating IC2 (which outputs a steady DC voltage of 1.5V feeding all sub-circuits of the circuit diagram 300), and switch SW1 which when open (default position) allows uninterrupted voltage supply to the all sub-circuits.

USB charging sub-circuit 340 allows charging battery BT1 by supplying 5-6V DC to IC1. USB charging circuit 340 is also directly connected to LEDs G (Green) and R (Red) which are also connected to IC1 and are lit by IC1 when the USB charging is in progress (Green LED is on and SW1 is closed) or disconnected (Red LED is on and SW1 is open). The USB charging sub-circuit 340 also comprises capacitors C17-C18 and resistors R12-R14

FIG. 5 is a table showing component count and specification for the circuit diagram 300 and the assembly of the hearing aid 100 in the current exemplary embodiment. This information is presented only for exemplary purposes and it is understood that modifications to both the count and specification of the components, as well as, the circuit diagram 300 are possible and fall within the purpose and content of the present invention as they can be conceived and implemented by any person of ordinary skill in related art. As a result this exemplary embodiment under no circumstance limits the possible alternative embodiments that also are part of the present invention.

Similarly, FIG. 6 is a table showing the technical specification details for the hearing aid 100 in the current exemplary embodiment.

Figure 7:
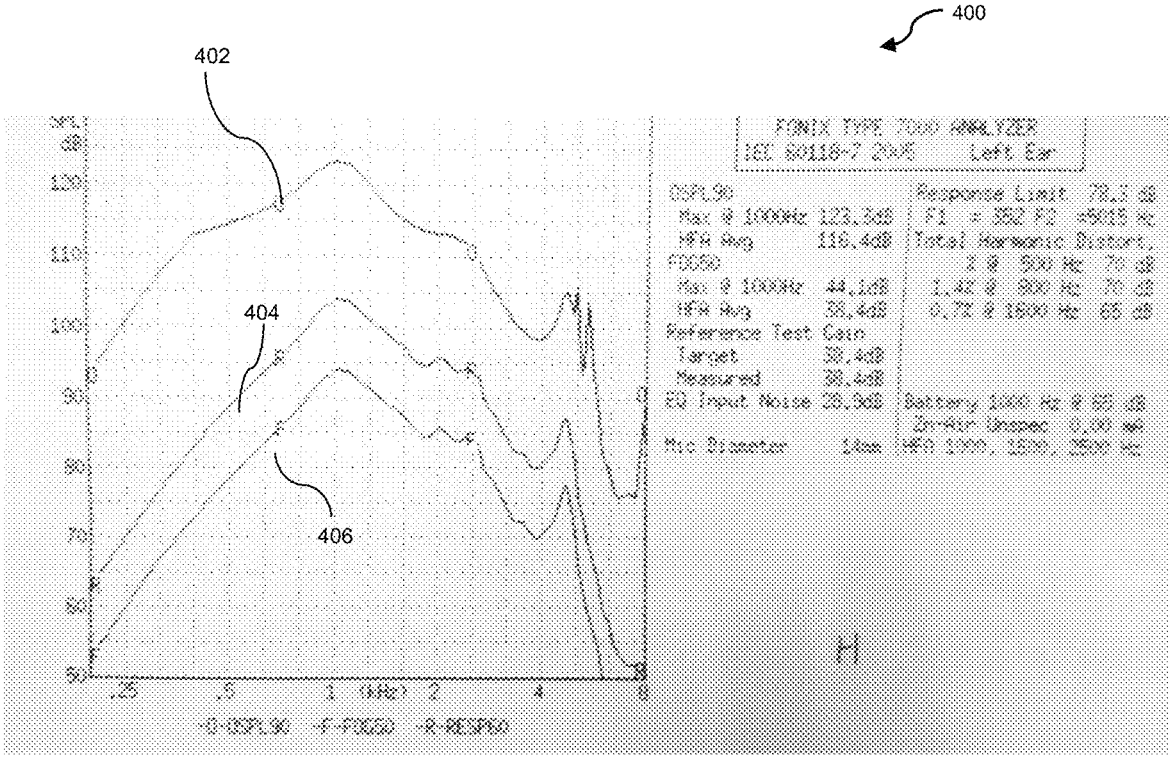
FIG. 7 shows the frequency response of adjusting pitch controls in accordance with the exemplary embodiment.

FIG. 7 shows the frequency response of adjusting pitch controls in accordance with the exemplary embodiment. Frequency response 402 depicts the highest pitch frequency response control setting. It can be seen that the relative amplitude frequency response 402 at approximately 1 kHz vs. 250 Hz is approximately 25 db, and the amplitude of the frequency response at higher frequencies (2 kHz) are only about 10 db lower than at 1 kHz. Thus there is a bias towards the higher frequencies above 1 kHz. Frequency responses 404 and 406 correspond to alternating levels of overall amplitude frequency response that the user may select via rocker switch 110. Those skilled artisans would appreciate that the number of possible frequency responses selected may be variable and not limited to 3, simply by using multiple digital or analog filters.

Figure 8:
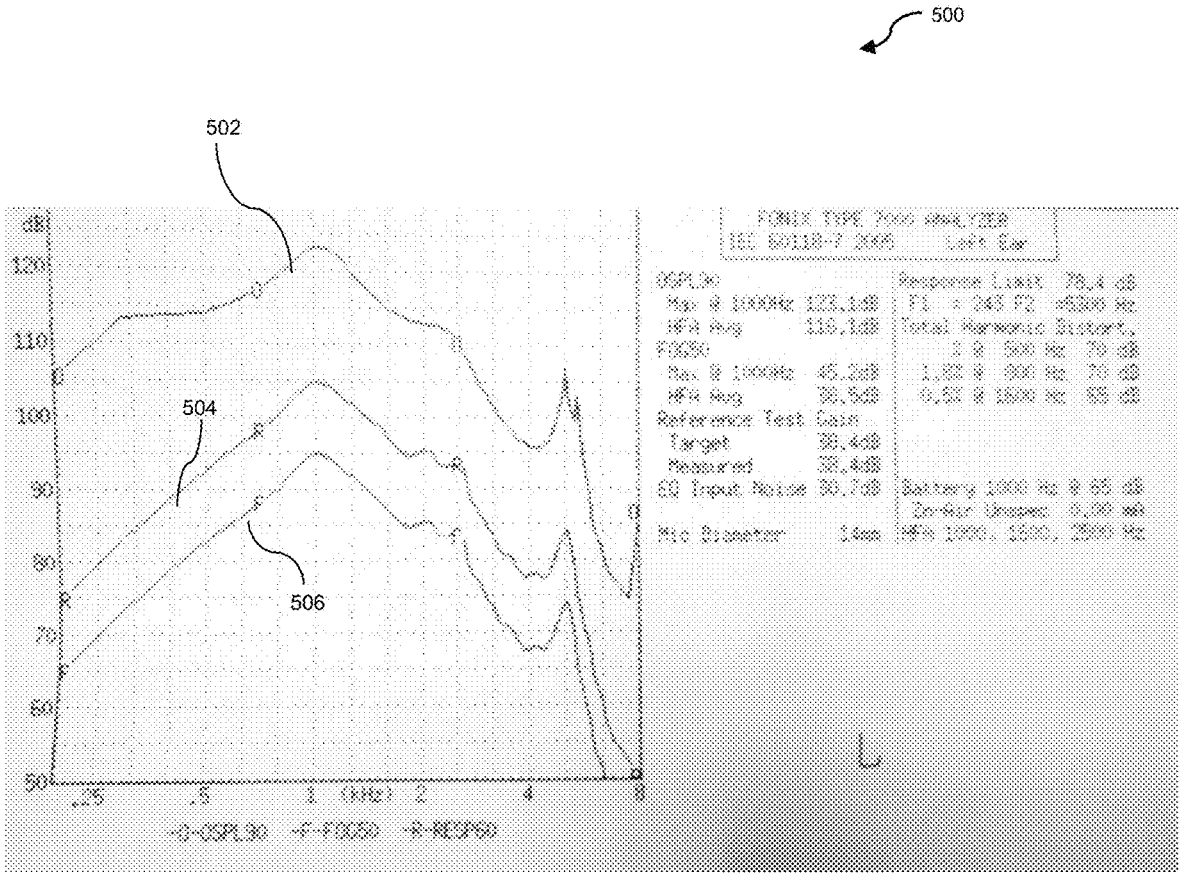
FIG. 8 shows the frequency response of adjusting bass controls in accordance with the exemplary embodiment.

FIG. 8 shows the frequency response of adjusting bass controls in accordance with the exemplary embodiment. Adjusting of bass controls is performed in a similar way as that of the pitch controls depicted in FIG. 4. Frequency response 502 depicts the highest bass frequency response control setting. It can be seen that the relative amplitude frequency response 502 at approximately 1 kHz vs. 350 Hz is approximately 10 db, and the amplitude of the frequency response at higher frequencies (2 kHz) are only about 10 db lower than at 1 kHz. Thus there is a bias towards the lower frequencies below 1 kHz. Frequency responses at 2 kHz are not as attenuated as in the pitch response case in FIG. 4 mainly due to the human ear naturally having a decreased frequency response at 2 kHz vs. low frequencies (for example 250 Hz). Frequency responses 404 and 406 correspond to alternating levels of overall amplitude frequency response that the user may select via rocker switch 112. Again, those skilled artisans would appreciate that the number of possible frequency responses selected may be variable and not limited to 3, simply by using multiple digital or analog filters that can be implemented easily using processor 102.

In accordance with an exemplary scenario, high and low volume control is set separately to address the specific and distinct needs of people with high-pitched hearing loss and low-pitched hearing loss, respectively.

From a user's perspective, the user is provided with user manual (user guide) which instructs the user on the appropriate manner to set the device for optimum hearing. In this regard, the user may be instructed to set the hearing aid device one way, when the user suffers from high-pitched hearing loss, and a different way, when the user suffers from low-pitched hearing loss. In both instances, at initial use of operation, the user is instructed to first turn the volume to the lowest level. This is to protect the user from excessively high noise, but also because it provides a reference point to start the setting of the hearing aid device to the optimum setting.

Having minimized the volume, the user is then instructed to turn "ON" the device (via power switch 104).

The user is then guided to regulate the volume to a proper level slowly. For this step, it helps if the user is aware of his hearing loss deficiency in terms of high or low pitched hearing loss. In the case of low-pitched hearing loss, low pitch (bass) rocker switch 110 is moved or pressed to increase bass frequency response (tone/volume control) (i.e., pressed into position 206). To control (lower) the tone/volume control when the optimum setting seems to have been exceeded, the finger is moved from position 206 to position 208 and pressed (one press at a time) to set the device to the optimum tone and volume level. The default position of the rocker switch is a middle position between positions 206 and 208. In one scenario, rocker switches return to the middle position automatically when released from either position 206 or 208. In another scenario, the rocker switch is a toggle switch and the tone/volume control is increased in predetermined time intervals up to a maximum level.

In a similar manner, in the case of high-pitched hearing loss, high pitch (treble) rocker switch 112 is moved or pressed to increase pitch frequency response (tone/volume control) (i.e., pressed into position 214).

Below are representative instructions to the user in accordance with a preferred embodiment. Each rocker switch includes (+) and (−) indications to indicate increase and decrease of tone volume control direction. Beeping is provided to provide audible indication of changes (single "beep") as well as indication that the maximum level has been reached (double "beep).

User Instructions: High Tone/Volume CONTROL (Fit for People Who Have High-Pitched Hearing Loss)

a) Press and hold "+" to turn up the volume and high pitch level continuously, and you will hear sound "Beep". Number of levels: eight (8). When the sound reaches peak level (level 8), you will hear sound "Beep-Beep".

b) Press and hold "−" to turn down the volume and high pitch level continuously, and you will hear sound "Beep". When the sound reaches the bottom level, you will hear sound "Beep-Beep".

User Instructions: Low Tone/Volume Control (Fit for People Who Have Low-Pitched Hearing Loss)

a) Press and hold "+" to turn up the volume and low pitch level continuously and you will hear sound "Beep". Number of levels: eight (8). When the sound reaches peak level, you will hear sound "Beep-Beep".

b) Press and hold "−" to turn down the volume and low pitch level continuously, and you will hear sound "Beep". When the sound reaches the bottom level, you will hear sound "Beep-Beep".

In an alternate exemplary scenario, the user instructions are provided audibly. The instructions may include guidance on how best to set rocker switch settings for people with both high and low tone deficiencies. In some instances, for users that are not sure whether they are high or low tone deficient, they may be guided to experiment toggling between the various levels and settings until a satisfactory (best) level is detected.

It should be appreciated that one benefit of the present invention is the ability of a user to set a hearing aid device to operate/amplify high or low tones in ways which until now has been traditionally performed by programmably set analog and digital hearing devices, usually under the guidance of a doctor. The latter approach is both expensive and cumbersome. The present approach addresses the need for low cost alternatives.

While some custom digital hearing aid solutions in particular allow for tone/volume control over a predefined frequency response curve, conventional devices do not have multiple bass and treble setting tone/volume control mechanisms as contemplated herein.

While the proposed multiple tone/control mechanisms provide a low cost alternative for people with hearing loss or similar deficiencies, these devices can also be used to amplify treble frequencies (bass frequencies) to improve hearing in outdoor (indoor) environments for better sound reception overall by a user. In similar manner, low tone/volume control can also provide an ancillary benefit of improving special effects sounds/music for some listeners. In this regard, the presently proposed device can function as a personalized amplification device to accommodate a variety of uses and needs of different users.

The use of toggle switches is common in traditional hearing aid devices. The use of rocker switches to control tone/volume control has been proven to be easier to use. This is therefore another benefit of a preferred exemplary embodiment.

The presently proposed approach, as has been shown, is easily incorporated in a small form function as well, allowing its use in hearing aids with a conventional shape with which many elderly are accustomed and comfortable in terms of use, fit, look, and the like. The only difference, of course, is learning to set the two rocket switches to the appropriate levels.

Traditional amplification devices, particularly those with rotating controls or toggle switches to set volume levels, incorporate the power on/off functionality in the volume control mechanism. In the exemplary embodiment, a separate power switch is provided without compromising the small form factor design of the device.

Those of skill in the art would understand that signals may be represented using any of a variety of different techniques. For example, data, software, instructions, signals that may be referenced throughout the above description may be represented by voltages, currents, electromagnetic waves, magnetic fields or particles, light or any combination thereof.

Those of skill would further appreciate that the various illustrative radio frequency or analog circuit blocks described in connection with the disclosure herein may be implemented in a variety of different circuit topologies, on one or more integrated circuits, separate from or in combination with logic circuits and systems while performing the same functions described in the present disclosure.

Those of skill would also further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the disclosure herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor may read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but are to be accorded the widest scope consistent with the principles and novel features disclosed herein.

What is claimed is:

1. In a hearing aid device configured with a high tone/volume control mechanism and a low tone/volume control mechanism, a method comprising:

detecting a change in high tone/volume control level at the high tone/volume control mechanism;

detecting a change in low tone/volume control level at the low tone/volume control mechanism; and independently adjusting the treble and bass frequency amplification response of the hearing aid device in response to the detected changes in the high tone/volume control levels;

wherein the low and high tone/volume control mechanisms are two separate, independent controllable rocker switches; and wherein each of the low and high tone/volume control mechanisms is configured to be set to one of a predetermined number of tone/volume control levels, the method further comprising identifying tone/volume control level settings, matching the settings to a corresponding frequency response curve and amplifying a received input signal into a microphone in accordance with the frequency response curve.

2. In a hearing aid device configured with a high tone/volume control mechanism and a low tone/volume control mechanism, a method comprising:

detecting a change in high tone/volume control level at the high tone/volume control mechanism;

detecting a change in low tone/volume control level at the low tone/volume control mechanism; and independently adjusting the treble and bass frequency amplification response of the hearing aid device in response to the detected changes in the high tone/volume control levels;

wherein the method further comprises identifying a maximum or minimum tone/volume control level setting and generating a first audible sound;

wherein the method further comprises generating a second audible sound in response to a change from one of the low and high tone/volume control mechanisms;

wherein the hearing aid device is an over-the-ear-type hearing aid;

wherein the low and high tone/volume control mechanisms are two separate, independent controllable rocker switches; and wherein each of the low and high tone/volume control mechanisms is configured to be set to one of a predetermined number of tone/volume control levels, the method further comprising identifying tone/volume control level settings, matching the settings to a corresponding frequency response curve and amplifying a received input signal into a microphone in accordance with the frequency response curve.

* * * * *